United States Patent [19]

Hartkopf

[11] 4,361,022

[45] Nov. 30, 1982

[54] WORKPIECE GUIDES FOR STRAIGHTENING APPARATUS

[75] Inventor: Heinz Hartkopf, Solingen, Fed. Rep. of Germany

[73] Assignee: Th. Kieserling & Albrecht GmbH K.G., Solingen, Fed. Rep. of Germany

[21] Appl. No.: 165,219

[22] Filed: Jul. 1, 1980

[30] Foreign Application Priority Data

Jul. 7, 1979 [DE] Fed. Rep. of Germany ..... 2927542

[51] Int. Cl.[3] ..... B21D 3/04

[52] U.S. Cl. ..... 72/99; 72/95

[58] Field of Search ..... 72/95, 99

[56] References Cited

U.S. PATENT DOCUMENTS

| | | | |
|---|---|---|---|
| 594,482 | 11/1897 | Medart | 72/95 |
| 850,810 | 4/1907 | Worth et al. | 72/99 |
| 2,163,669 | 6/1939 | Didden . | |
| 2,650,639 | 9/1953 | Hampton | 72/95 |

FOREIGN PATENT DOCUMENTS

| | | | |
|---|---|---|---|
| 392028 | 3/1924 | Fed. Rep. of Germany . | |
| 508209 | 9/1930 | Fed. Rep. of Germany | 72/99 |
| 1913948 | 4/1965 | Fed. Rep. of Germany . | |
| 2243531 | 9/1973 | Fed. Rep. of Germany | 72/99 |
| 2307128 | 6/1974 | Fed. Rep. of Germany . | |
| 1498642 | 1/1978 | United Kingdom . | |

*Primary Examiner*—Lowell A. Larson
*Attorney, Agent, or Firm*—Edward E. Sachs

[57] ABSTRACT

Straightening apparatus includes opposed straightening rollers through which generally cylindrical elongated workpieces pass generally longitudinally. Opposite flat guide members extend between the rollers and have opposed front guide edges between which a workpiece is guided as it travels through the rollers. The side edges of the guide members extending generally perpendicular to the direction of workpiece travel are individually releasably clamped by clamping devices for providing adjustment of the guide members toward and away from a workpiece to facilitate initial adjustment and to renew the front guide edges as they become worn. Each individual clamping device is also independently adjustable in a direction generally perpendicular to the first adjustment direction for imparting curvature to the guide members extending between curved straightening rollers.

7 Claims, 3 Drawing Figures

WORKPIECE GUIDES FOR STRAIGHTENING APPARATUS

BACKGROUND OF THE INVENTION

This application relates to the art of workpiece straightening apparatus and, more particularly, to such straightening apparatus having opposed straightening rollers for straightening elongated generally cylindrical workpieces, such as rods, pipes or wire, which pass generally longitudinally between the rollers. The invention is particularly applicable to improved guide members and guide member mounting arrangements for use in straightening apparatus of the type described.

Known straightening apparatus having opposed straightening rollers uses opposite guide members having front guide edges of expensive special hard material for reducing wear of the guide edges as the workpieces travel therepast. The prior guide members are also expensive because they require openings for accommodating the outwardly flared bell ends of the concave straightening roller, particularly for small diameter workpieces.

An example of a known guide arrangement for a straightening apparatus is described in German Utility Model No. 6,930,960. The straightening rollers are vertically opposed and a guide member is mounted to a holder hingedly connected outwardly and below the lower straightening roller at a hinge connection located along a line extending at approximatey a 45° angle to the vertical from the path of a workpiece through the straightening rollers. It is possible to swing the guide holders about their hinge connections for setting the guides to workpieces of different diameters.

SUMMARY OF THE INVENTION

Straightening apparatus having opposed straightening rollers through which a workpiece passes includes guide members extending between the rollers for laterally guiding workpieces therethrough. The guide members are adjustable toward the workpiece for renewing the guide members as the front guide edges thereof are worn away. For this purpose, the opposite side edge of each guide member are held by releasable clamping devices which are also mounted for movement to allow curvature of the guide members which may be generally flat rectangular sheets of flexible plastic material.

Weight compensating means is provided for each clamping device for allowing movement of each clamping device so that a guide member may conform to the curvature of the straightening rollers. That is, the guide edge of each guide member may conform generally to the bending path of the workpiece passing through the rollers.

It is a principal object of the present invention to provide an improved workpiece straightening apparatus.

It is an additional object of the present invention to provide an improved guide assembly for a workpiece straightening apparatus.

It is a further object of the invention to provide an improved adjustable mounting arrangement for guide members in a workpiece straightening apparatus.

DESCRIPTION OF PREFERRED EMBODIMENTS

Figure 1:
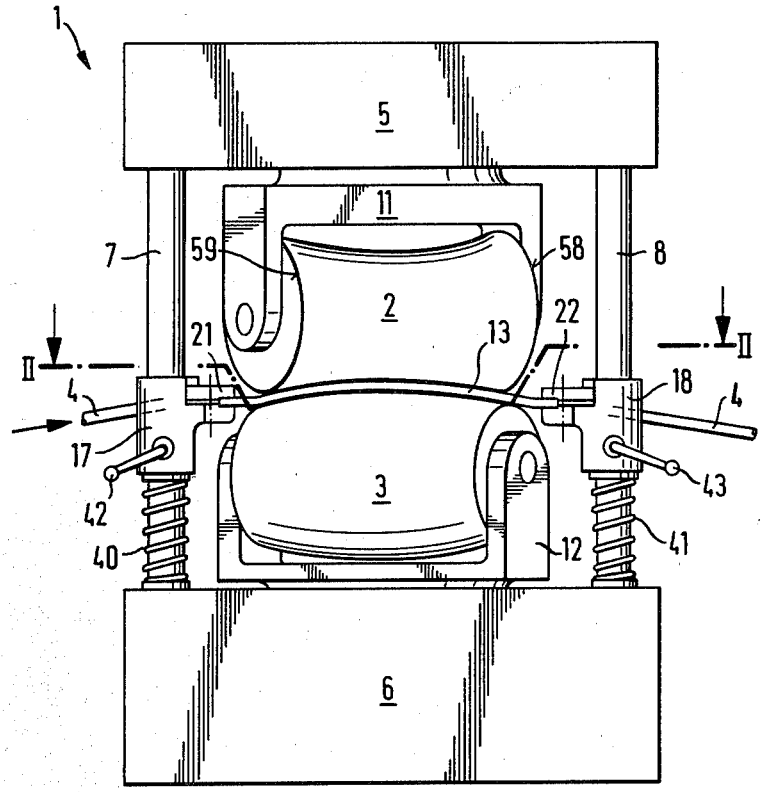
FIG. 1 is a side elevational view of a straightening apparatus having the improved workpiece guide assembly of the present application incorporated therein.
Figure 2:
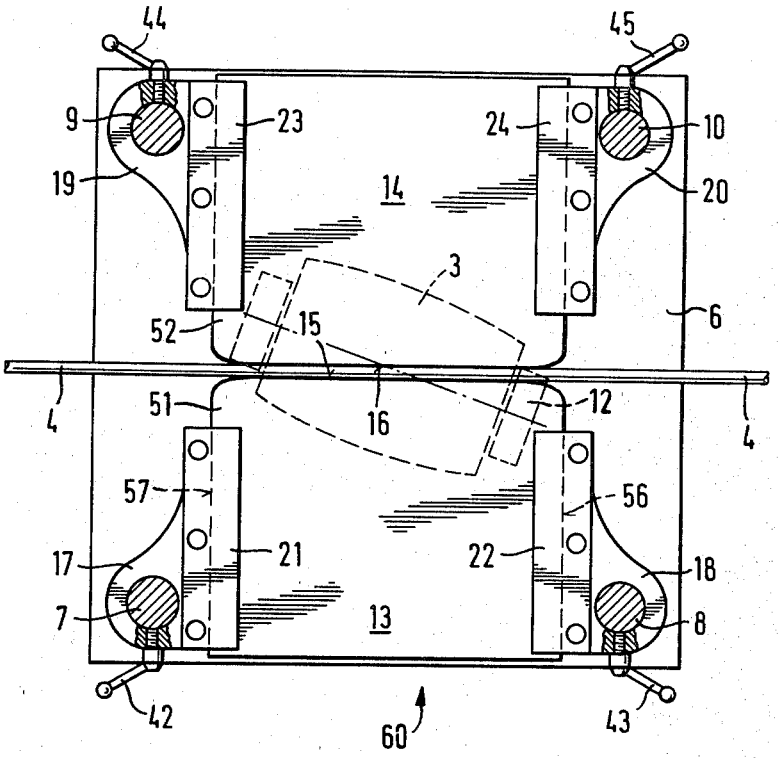
FIG. 2 is a cross-sectional plan view taken generally on line II—II of FIG. 1.

With reference to the drawing, and particularlyFIGS. 1 and 2, a workpiece straightening apparatus 1 includes vertically opposed straightening rollers 2, 3 through which an elongated generally cylindrical workpiece 4 passes generally longitudinally from left to right in FIGS. 1 and 2. The workpiece 4 may be in the form of a rod, pipe or wire of various diameters.

The roller 2 is shown as a concave straightening roller having outwardly flared or bell ends 58, 59, while the lower straightening roller 3 is shown as a convex roller. It will be recognized that cylindrical rollers can also be used in various combinations with concave and convex rollers.

The straightening rollers 2, 3 are respectively rotatably mounted to holders 11,12 which in turn are respectively attached to upper and lower parts 5,6 of the apparatus frame. At least the upper roller holder 11 is vertically adjustable relative to the upper frame part 5 in a known manner for moving the upper straightening roller 2 toward and away from the lower straightening roller 3 to selectively vary the gap therebetween for accommodating workpieces of different diameters.

The straightening rollers 2,3 are positioned with their axes crossing one another in a known manner. That is, the axes of the rollers, when viewed from above, are in the form of an "X".

It will be recognized that a workpiece 4 is worked by bending same as it passes generally longitudinally through the rollers 2,3 while being rotated about its own axis. The general path of movement of a workpiece 4 may be generally visualized by having the workpiece 4 in FIG. 2 represent its own path of movement. The workpiece passes through the rollers more parallel to the roller axes than perpendicular to such axes. The workpiece 4 is rotated and fed generally longitudinally through the rollers 2,3.

Vertical corner posts 7, 8, 9 and 10 extend between the upper and lower frame parts 5,6. Clamping means in the form of clamping devices 17, 18, 19 and 20 are respectivelyslidably received on the posts 7–10. Selectively operable screw locks 42, 43, 44 and 45 are provided for selectively locking the clamping devices 17–20 in any desired adjusted position along the vertical posts 7–10, or allowing sliding movement of the clamping devices along the posts. Upper clamping members 21, 22, 23 and 24 cooperate with lower opposed flanges on the clamping devices 17–20 to define opposed clamping jaws. The clamping members 21–24 are adjustable toward and away from the lower flanges by means of bolts or other adjusting means. As shown in FIG. 2, the clamping members 21–24, and the lower flanges with which they cooperate to define clamping jaws, are elongated in a direction generally perpendicular to the movement path of a workpiece 4 through the straightening rollers.

Relatively thin and generally rectangular flat guide members 13, 14 extend between the straightening rollers 2,3 and have generally straight front guide edges 15,16. The guide members 13,14 have opposite side edges, two of which are shown at 56,57 for the guide member 13. The side edges 56,57 extend generally perpendicular to the front guide edge 15, and generally perpendicular to the workpiece 4 and its movement path. As shown in FIG. 2, the guide member 13 has a length between its opposite side edges 56,57, generally parallel to the workpiece 4, which is greater than the length of a straightening roller 3. In other words, each guide member 13,14 has a length generally parallel to the workpiece movement path so that the opposite side edges of each guide member are positioned beyond the ends of the straightening rollers 2,3. The guide members 13,14 extend between the rollers 2,3 so that the front guide edges 15,16 may engage opposite sides of the workpiece 4 as shown in FIG. 2.

The opposite side portions of each guide member 13, 14 are positioned between a clamping member 21–24 and the lower flanges cooperate therewith to define clamping jaws. The clamping members 21–24 are tightly clamped against the opposite sides of the guide members 13,14 adjacent the side edges thereof to hold same against movement. However, loosening of the fasteners holding the clamping members 21–24 allows adjustable movement of the opposed guide members 13,14 in one direction toward and away from the workpiece 4 and its path of movement. As the front guide edges 15,16 become worn from engagement with the workpieces passing through the rollers, the clamping members 21–24 may be loosened for allowing sliding adjustment of the guide members 13,14 toward the workpiece and this renews the front guide edges 15,16. The clamping devices 21–24 may then be tightened into clamping engagement with the guide members. This loosening and tightening of the guide members also takes place during initial adjustment of the apparatus for accommodating workpieces of different diameters.

As shown in FIG. 2, the leading corners 51,52 of the guide members 13,14 are tapered to define a funnel-like entry to the front guide edges 15,16. The depth of each guide member 13,14 in a direction generally perpendicular to the workpiece 4 may be only slightly less than one-half the depth of the apparatus itself, as shown in FIG. 2.

The clamping members 21,22 or 23,24 for each guide member are spaced-apart a distance greater than the length of a straightening roller along the movement path of the workpiece. This allows the guide members 13,14 to be clamped close to their front guide edges 15,16 while allowing projection of the guide members between the rollers as shown in FIG. 2. The use of separate clamping devices for each side edge portion of a guide member makes the straightening rollers more easily accessible from the operating side of the apparatus represented by numeral 60 in FIG. 2.

The improved guide members are easily deformed or curved so that the front guide or wear edges 15,16 are made to correspond generally with the line of bending of a workpiece 4 as it passes through the straightening rollers. Curvature of the guide members 13,14 also provides adequate free space for the straightening rollers without requiring special openings in the guide members for accommodating the bell ends of the concave roller 2. The wear occuring between the bell ends 58,59 and the guide members is negligible as compared to the wear occuring along the guide edges 15,16. The improved adjusting arrangement makes it possible to rapidly renew the guide edges 15,16 and this makes it unnecessary to provide special hard material or welded wear edges.

The individual adjustability of each clamping device 21–24 along its post 7–10 makes it possible to provide curvature to a guide member and to locate the leading corners 51,52 of the guide members at a proper height to guide a workpiece between the straightening rollers. Weight compensating means in the form of coil springs 40,41 are shown on the posts 7,8 to compensate for the weight of the clamping devices 17,18. Corresponding weight compensating devices are provided for the clamping devices 19,20. The screw locks 42,43 for the clamping devices 17,18 may be loosened while a workpiece is passing through the straightening rollers 2,3 for allowing the clamping devices 17,18 to oscillate on the posts 7,8 and seek an optimum position. The screw locks 42,43 are then tightened.

Although flexible plastic guide members have been described, it will be recognized that the improved guide member mounting and clamping arrangement of the present application can also be used with conventional guide members of steel with welded-on wear edges and openings for the bell ends of the concave upper straightening roller.

Figure 3:
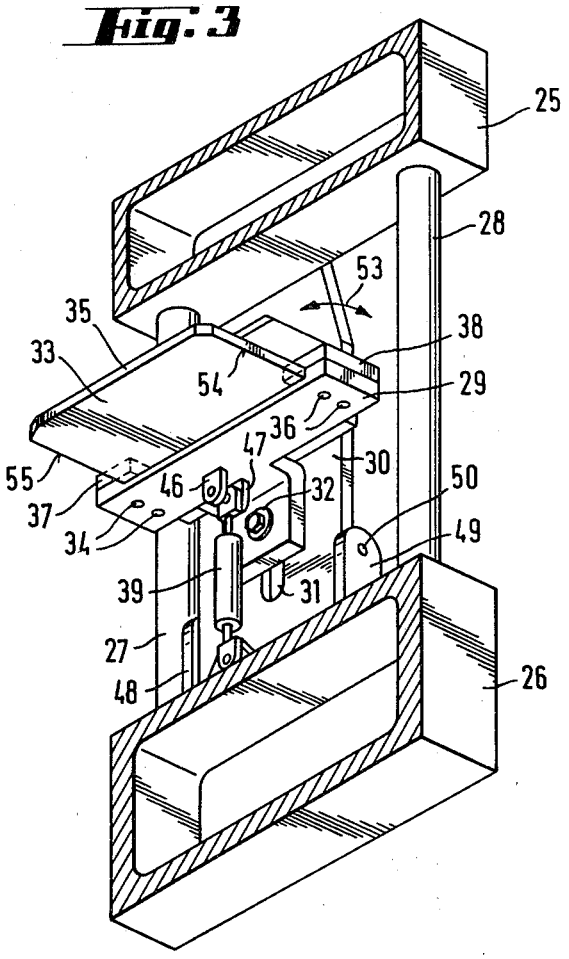
FIG. 3 is a perspective illustration of another arrangement for adjustably mounting a guide member.

The arrangement of FIG. 3 makes it possible to adapt existing apparatus to an adjustable guide member mounting arrangement according to the present application. In the arrangement of FIG. 3, upper and lower frame portions 25, 26 are connected by tension posts 27,28. A guide member mounting plate 30 is hingedly connected as by pins 50 to ears 48,49 on the lower frame portion 26 for swinging movement of the plate 30 as indicated by arrow 53. A suitable set screw adjusting arrangement may be provided adjacent the upper end portion of the plate 30 for locking same in an adjusted position.

A vertically elongated slot 31 in the plate 30 receives a releasable fastener assembly 32 extending through a downwardly projecting flange on a guide member hold 29. Loosening of the fastener assembly 32 allows vertical adjustment of the guide member holder 29. Tightening of the fastener assembly 32 locks the guide member holder 29 in its vertically adjusted position. A relatively thin and generally flat rectangular guide member 33 is clamped adjacent its opposite side edges 54,55 remote from its front guide or wear edge 35. Individual clamping members 37,38, similar to the clamping members 21–24 of FIG. 2, are releasably clamped to the holder 29 as by bolts 34,36. Loosening of the bolts 34,36 frees the clamping members 37, 38 for adjustable sliding movement of the guide member 33 toward and away from a workpiece. Tightening of the bolts 34,36 then locks the guide member 33 in adjusted position. This enables rapid renewal of the worn front guide edge 35.

In the arrangement of FIG. 3, a fluid cylinder 39 may be secured to the lower frame portion 26 and to ears 46,47 on the underside of the guide member holder 29 to compensate for the weight of the guide member assembly.

In setting up the apparatus for a straightening operation, the upper concave straightening roller 2 is moved upwardly away from the lower roller 3 to provide a gap therebetween. A suitable pattern corresponding to the size of a workpiece to be straightened is then introduced into the gap. With the clamping members 21–24 loosened, the guide members 13,14 are moved inwardly until their front guide edges 15,16 engage on opposite sides of the pattern. The clamping members 21–24 are then tightened. Instead of adjusting both of the opposite guide members 13,14 against the pattern, only one guide member 13 may be adjusted using the pattern. The pattern is then removed and a workpiece is introduced between the rollers for adjustment of the opposite guide member 14. The upper roller 2 is then lowered to provide a gap with the lower roller corresponding to the diameter of a workpiece to be straightened. The screw locks 42–45 for the clamping devices 17–20 may be loosened for allowing the clamping devices 17–20 to seek a desired or optimum position along the posts 7–10 while a workpiece is traveling through the straightening rollers. The screw locks 42–45 are then tightened. The clamping devices 17,19 at the leading end of the apparatus may be loosened and moved vertically on their posts 7,9 for properly locating the tapered corners 51,52 at a desired elevation to lead or guide workpieces between the rollers and the front guide edges. Loosening of the clamping devices 17–20 allows the guide members 13,14 to conform and adapt to the gap between the rollers 2,3. This gap between the rollers is normally substantially greater than the thickness of the guide members 13,14 because the diameter of workpieces 4 to be straightened is normally substantially greater than the thickness of the guide members 13,14.

The clamping means defined by the clamping devices 17–20 and their clamping members 21–24 provides adjustment of the guide members 13,14 in one direction toward and away from the workpiece, while movement of the clamping devices along the posts 7–10 provides adjustment in another direction generally perpendicular to the one direction.

While there have been described what are at present considered to be the preferred embodiments of this invention, it will be obvious to those skilled in the art that various changes and modifications may be made therein without departing from the invention, and it is aimed, therefore, in the appended claims to cover all changes and modifications as fall within the true spirit and scope of the invention.

What is claimed is:

1. Apparatus for straightening elongated cylindrical workpieces comprising: opposed straightening rollers through which elongated cylindrical workpieces are moved generally longitudinally, opposed guide members extending between said rollers and having front guide edges horizontally co-extensive with the rollers and positioned on opposite sides of a workpiece moving between said rollers, said guide members having opposite side edges, releasable clamping means for releasably clamping said guide members adjacent said side edges thereof for a first individually adjustable vertical movement of said guide members relative to a workpiece in situ for properly locating said front guide edges vertically with respect to said workpiece during initial or intermittent adjustment, and said clamping means further providing a clamping device for each side edge for effecting a second individually and generally horizontally adjustable movement thereof in a direction perpendicular to the first movement.

2. The apparatus of claim 1 wherein said guide members are of flexible plastic material.

3. The apparatus of claim 1 wherein said clamping devices are generally vertically movable and including weight compensating means for each said clamping device.

4. The apparatus of claim 1 including a pair of said guide members having said front guide edges thereof positioned in opposed relationship on opposite sides of a workpiece, each side edge of each said guide member having one of said releasable clamping devices cooperating therewith.

5. In a straightening apparatus including opposed straightening rollers through which generally cylindrical workpieces pass generally longitudinally for straightening same, guide means extending between said rollers for guiding workpieces therethrough, each guide means including a guide member having a horizontally extending front guide edge disposed along the movement path of the workpiece horizontally co-extensive with the rollers, each of the guide edges being defined by generally flat sheet stock of plastic material having a degree of hardness that is softer when compared to special hardness steel, releasable clamping devices independently clamping said guide member adjacent each said side edge thereof, said clamping devices being releasable for moving said guide member in one direction toward and away from a workpiece for properly locating said front guide edge with respect to a workpiece during initial adjustment and as said front guide edge becomes worn, and each said clamping device being independently movable in a direction generally perpendicular to said one direction.

6. The apparatus of claim 5 wherein said rollers are vertically opposed and including an apparatus frame having generally vertical posts, and said clamping devices being adjustably movable vertically along said posts.

7. The apparatus of claim 6 including weight compensating means below said clamping devices.

* * * * *